US005678258A

United States Patent [19]

Healy

[11] Patent Number: 5,678,258

[45] Date of Patent: Oct. 21, 1997

[54] MULTIPLE SHOWERHEAD APPARATUS

[76] Inventor: Thomas K. Healy, 2107 Main St., Santa Monica, Calif. 90405

[21] Appl. No.: 536,569

[22] Filed: Sep. 29, 1995

[51] Int. Cl.[6] ..... A47K 3/22

[52] U.S. Cl. ..... 4/601; 4/605; 4/695

[58] Field of Search ..... 4/601, 605, 615, 4/570, 600, 670, 695, 559

[56] References Cited

U.S. PATENT DOCUMENTS

| | | | |
|---|---|---|---|
| 3,121,235 | 2/1964 | Gellmann | 4/601 X |
| 3,375,532 | 4/1968 | Gellmann | 4/601 X |
| 4,457,031 | 7/1984 | Moore | 4/605 X |

*Primary Examiner*—Robert M. Fetsuga
*Attorney, Agent, or Firm*—Roger A. Marrs

[57] ABSTRACT

An apparatus is disclosed herein having a wall-mounted water pipe supporting a plurality of individual showerheads by swivel joints and manually operated individual ON/OFF valves. A selected one of the showerheads is carried on the end of a cantilevered extension pipe of reduced diameter which outwardly projects above and beyond the other showerheads. An accessory rack is detachably mountable on the water pipe and encloses the water pipe. Apertures are provided on the housing through which the showerheads protrude. A drainage valve at the lower end of the water pipe eliminates excess water in the water pipe after use.

2 Claims, 1 Drawing Sheet

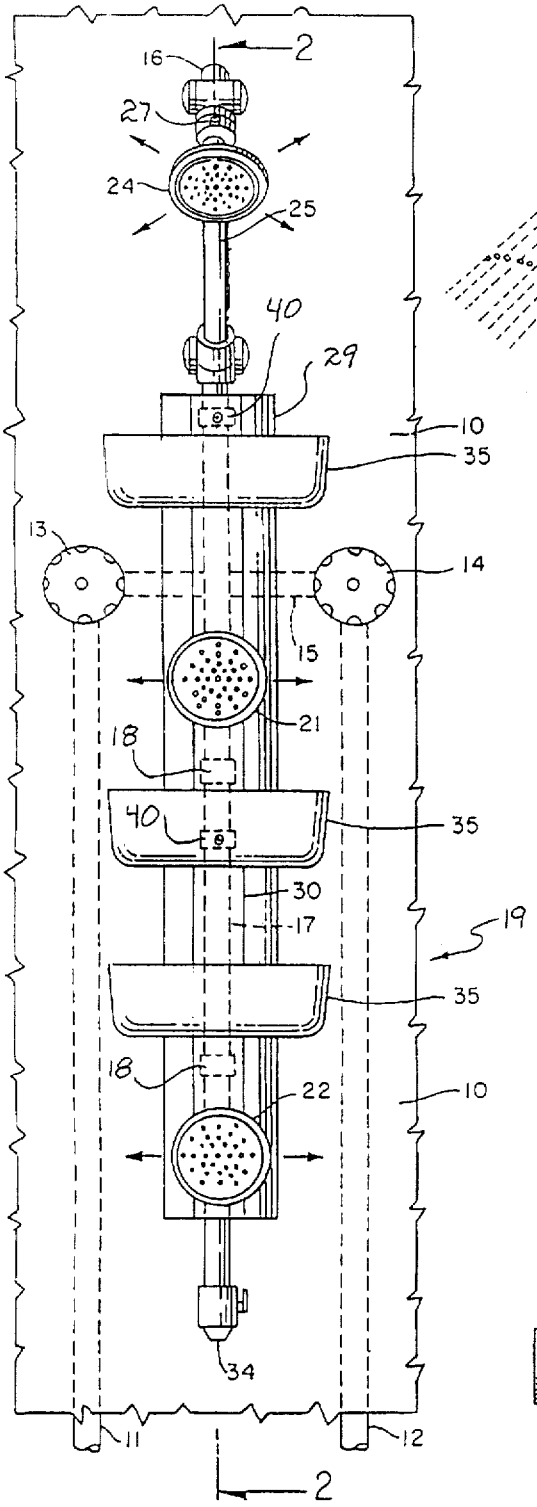
FIG. 1.
FIG. 3.
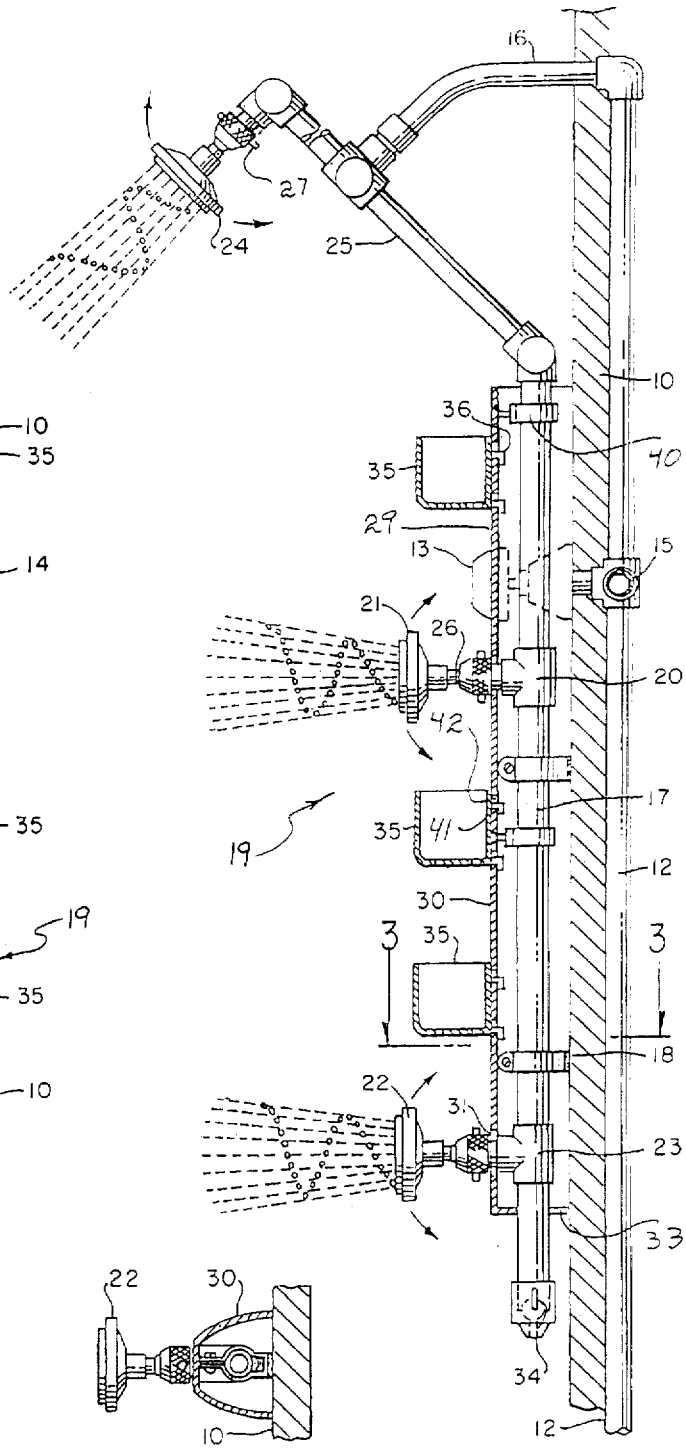
FIG. 2.

MULTIPLE SHOWERHEAD APPARATUS

BACKGROUND OF THE INVENTION

1. Field of the Invention

The present invention relates to the field of water massaging apparatus, and more particularly to a novel wall-mounted water massaging unit having a plurality of showerheads conveniently mounted or installed in a conventional shower stall and which includes individual manual controls for water adjustment and intensity of discharge.

2. Brief Description of the Prior Art

In the past, it has been the conventional practice to employ a single showerhead in a shower stall which is intended to discharge water over the body of a person engaged in showering. By the user manipulating rotary ON and OFF valves, the intensity of the water can be adjusted to the intensity desired by the user. However, difficulties have been encountered because the discharge of the showerhead cannot be conveniently placed to impinge against the midsection or lower body areas of the user and the user generally has to settle for the water impingement being directed against the neck and shoulder area only. Also, the user is at a disadvantage since only a single showerhead is provided which greatly reduces the massage effect.

Although attempts have been made to provide multiple water jet discharge for massaging purposes, such apparatus is generally employed only in connection with bathing tubs or the like in which the user is submerged in a body of water.

Such water massaging jets are not individually controlled and it is the usual practice for the user to place his body in a particular position in order to receive the benefit of the massaging jet. It is not possible to place the plurality of jets or water discharging heads so as to place impinging water against selected body areas.

Other problems have been encountered because prior massaging jets are generally permanently installed in a tub system which involves a great deal of plumbing and extensive installation in wall and floor areas.

Therefore, a long-standing need has existed to provide a novel showerhead apparatus which may be employed for body massage that includes a plurality of showerheads easily manipulated by the user to control direction of water discharge and intensity thereof. Also, it is of great benefit to make such an apparatus portable and easily installable in a conventional shower stall without extensive remodeling or reconstruction.

SUMMARY OF THE INVENTION

Accordingly, the above problems and difficulties are obviated by the present invention which provides a water pipe coupled to the main water supply line of pressurized water and wherein a plurality of showerheads are operably coupled to the water pipe by swivel means so that the user can orient each of the respective individual showerheads in a desired direction. An extension arm is carried at the top of the water pipe so as to outwardly project above and beyond the other showerheads so that a downward discharge of water may be provided to the user. Each of the individual showerheads includes its own shutoff valve for ON/OFF purposes and a water flow intensity valve is included so that the user may select the intensity level of each individual showerhead. A removable housing or cover is detachably carried on the water pipe and may also be employed to mount conveniences such as soap dishes, cloth holders or the like. Means such as expandable clips or the like may be provided for detachably connecting the housing to the water pipe and a drainage valve is employed for voiding any residue water from the water pipe after a showering procedure. The water pipe may be attached to the shower wall with adhesive.

Therefore, it is among the primary objects of the present invention to provide a novel showering or massage unit comprising a plurality of individual showerheads that may be readily installed in an existing shower stall in a convenient and relatively inexpensive manner.

Another object of the present invention is to provide a novel shower massaging apparatus having a plurality of shower heads that are individually operated and individually controlled for selectively directing a discharge of water and which may be wall-mounted on the vertical wall surface of a shower stall.

Yet another object of the present invention is to provide a novel water massaging apparatus having a multiplicity of hydro-massaging showerheads which may be directed independently for hydro-massaging the upper, middle and lower parts of the back of the user and which is especially beneficial for therapeutic hydro-massage.

A further object of the present invention is to provide a novel water wall shower fixture having multiple and independent showerheads which may be useful for therapeutic hydro-massage as well as useable with standard showerheads.

Another object of the present invention is to provide a novel hydro-massaging apparatus which may be incorporated with an accessory rack for storage of products such as shampoo, soap and other miscellaneous shower accessories.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front elevational view of the novel hydro-massage apparatus of the present invention;

FIG. 2 is a side elevational view of the hydro-massage apparatus shown in FIG. 1 as taken in the direction of arrows 2—2 thereof; and FIG. 3 is a transverse cross-sectional view of the hydro-massage apparatus as taken in the direction of arrows 3—3 of FIG. 2.

DESCRIPTION OF THE PREFERRED EMBODIMENT

Referring to FIG. 1, a conventional shower stall is indicated by numeral 10 which represents a vertical wall forming a part of the stall. As is the conventional practice, hot water is provided via a conduit 11 while cold water is provided via a conduit or pipe 12. The hot and cold supply of water is selected by valves connected with knobs 13 and 14 respectively whereby the hot and cold water is combined in a common conduit 15 for supply to an outlet conduit 16 near the top of the stall.

Referring to FIGS. 1 and 2, the novel hydro-massaging apparatus of the present invention is indicated in the general direction of arrow 19 and it includes an elongated main water pipe 17 carried on the flat wall surface 10 by means such as a plurality of adhesively attached stand-offs, as indicated by numeral 18. The water supply pipe 17 further includes a fitting such as fitting 20 which carries a hydro-massage showerhead 21 as well as showerhead 22 associated with fitting 23. It is to be understood that the showerheads may be mounted in columns and rows so as to provide a pattern of water discharge from each of the respective showerheads. However, for illustrative purposes, only showerheads 21 and 22 are illustrated in connection with the water supply pipe 17 and showerhead 24 is included as being mounted from an extension tube or conduit 25 that is in fluid communication with the supply conduit 16 and the water pipe 17. It is to be particularly noted that each of the respective showerheads is mounted on a swivel connection such as swivel 26 shown in connection with showerhead 21 as well as ON/OFF valve 27. Tube 25 is of reduced diameter.

It is also to be noted that the apparatus includes a housing or cover 30 that includes apertures through which the respective hydro-massaging showerheads project and such an aperture is indicated by numeral 31 in connection with showerhead 22. An opening 33 is provided at the bottom of the housing 30 to accommodate the end of the water pipe 17. The residue water from the water pipe 17 may escape through a manual gate valve 34. When water is pressurized and present within the pipe 17, the gate of the valve will close the orifice through which the water would normally pass. However, When the water is not pressurized as when the device is not in use, the residue water will collect in the valve 34 and can be released by opening of the valve 34 so that the water will drip or pass through.

Referring now in detail in FIG. 3, it can be seen that the housing 30 of the apparatus further includes accessory dishes, indicated by numeral 35. The accessory dishes may include a plurality of compartments for the storage of accessories used in the shower, such as soaps, shampoo bottles, brushes or the like.

Each of the individual showerheads may be rotated about its swivel connection to a desired orientation for discharge of the water stream so as to direct the stream against the shoulders, back, hips, legs or other parts of the user's body. Since conventional showerheads are employed, any sort of aeration or discharge openings for the water may be provided and selected by the user.

Therefore, it can be seen that the novel shower apparatus of the present invention supports multiple, independent hydro-massaging showerheads and that a separate ON/OFF switch is employed for each showerhead so that any number of showerheads may be placed into use at one time. A water flow means in each switch valve 13 in cooperation with showerheads 21, 22 and 24 is employed for regulating the amount of water flowing through each of the heads and allows each individual to control water usage. Each showerhead is readily adjustable by the user to point in a desired direction and the number of directions is various. With hydro-massaging showerheads, the user may hydro-massage the upper, middle and lower parts of the back which is especially beneficial for therapeutic hydro-massage. The device may also be used with standard showerheads at the selection of the user.

The shower apparatus can be attached to any standard shower stall and may be temporarily or permanently secured to the shower stall. The plumbing can be composed of PVC plastic, copper, stainless steel, brass, or other materials. The decorative plate 30 which covers the fixture connections hides the plumbing and the tubing from view. The shelves or dishes 35 allow storage for products such as shampoo, soap and other miscellaneous slower accessories.

It is emphasized that the pressurized water supply pipe 12 is behind the shower wall as a part of original home or dwelling construction and that water conduit 17 along with the housing and showerheads is portable and attached to the exterior or outer wall surface in parallel spaced-apart relationship with respect to supply 12. The wall 10 separates the two pipes or conduits. Also, in side elevational view, as shown in FIG. 2, the conduit 17 lies along a vertical plane while the upper selected showerhead 24 is above and beyond the vertical plane of alignment of the other showerheads. The housing 29 is detachably carried on the water conduit 17 by snap clips 40. The accessory dishes or containers 35 are detachably carried on the housing by insertion of hook elements 41 through apertures 42 in the housing.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A wall-mounted shower stall showering apparatus comprising:

a shower stall having an exposed wall surface;

a main water conduit attached to said exposed wall surface of said shower stall and outwardly projecting therefrom;

at least three showerheads carried on said main water conduit in spaced-apart relationship;

a selected one of said plurality of showerheads carried on an end of said main water conduit and extending over and beyond said other showerheads in said plurality;

means disposed behind said exposed wall surface operably coupled to said main water conduit for supplying pressurized water to said showerheads;

a housing carried on said main water conduit exposing said showerheads via an opening associated with each showerhead;

means disposed on said main water conduit separate from said housing for detachably mounting said main water conduit to said exposed wall surface;

an elongated extension pipe having opposite ends and one end carried on said main water conduit in water communication therewith and said selected showerhead carried on the other end of said extension in vertical alignment therewith;

said water supplying means is directly connected to said extension pipe midway between said opposite ends;

swivel means operably connecting each of said showerheads to said main water conduit and to said extension pipe respectively whereby each of said showerheads is movable with respect to said main water conduit for discharging a water spray in a variety of selected directions and collective cooperating patterns;

a plurality of storage containers carried on said housing in fixed spaced-apart relationship and between said showerheads for storing a variety of shower and bathing accessories;

flow adjustment means incorporated into each of said showerheads for regulating water intensity and water flow shut-off whereby adjustment is separately and individually selected among said plurality of showerheads;

a manually operated drainage valve disposed on the end of said main water conduit opposite to its end carrying said extension pipe for draining residue water from said main water conduit in the absence of pressurized water;

said detachable mounting means includes at least two standoffs wherein each standoff has a front side and back side;

said detachable mounting means further including an adhesive attachment for securing said rear side of said standoff to said exposed wall surface; and said extension pipe has a diameter smaller than the diameter of said main water conduit.

2. A wall-mounted shower stall showering apparatus comprising:

a shower stall having an exposed interior wall surface;

a main water conduit attached to said interior wall surface of said shower stall and outwardly projecting therefrom;

a plurality of showerheads carried on said main water conduit in spaced-apart relationship;

a selected one of said plurality of showerheads pivotally carried on an end of said main water conduit and extending over and beyond said other showerheads in said plurality;

said non-selected showerheads of said plurality of showerheads being in vertical alignment along a vertical plane and said selected one of said plurality of showerheads offset from said vertical plane as viewed in side elevation;

means disposed behind said wall surface and operably coupled to said main water conduit for supplying pressurized water to said plurality of showerheads;

a housing carried on said main water conduit exposing said plurality of showerheads;

means disposed on said main water conduit separate from said housing for detachably mounting said main water conduit to said interior wall surface;

attachment means securing said housing to said main water conduit;

an elongated extension pipe having opposite ends with one end carried on said main water conduit in water communication therewith and said selected showerhead carried on the other end of said extension pipe;

said water supplying means is directly connected to said extension pipe midway between said opposite ends;

swivel means operably connecting each of said plurality of showerheads to said main water conduit and said extension pipe respectively whereby each of said plurality of showerheads is movable with respect to said main water conduit for discharging a water spray in a variety of individual directions and cooperating collective patterns;

at least three storage containers detachably carried on said housing between said showerheads for storing a variety of shower and bathing accessories;

flow adjustment means incorporated into each of said plurality of showerheads for regulating water intensity and water flow shut-off whereby adjustment is separately and individually selected among said plurality of showerheads; and a manual drainage valve disposed on the end of said main water conduit opposite to its end carrying said extension pipe for draining residue water from said main water conduit in the absence of pressurized water, said valve having a manually operated gate valve for alternately opening and closing said valve when either is flooded by the pressurized water and in the absence of the pressurized water respectively.

* * * * *